US008886080B2

(12) United States Patent
Allen et al.

(10) Patent No.: US 8,886,080 B2
(45) Date of Patent: Nov. 11, 2014

(54) CLEANER UNIT FOR REMOVING WASTE TONER WITHIN AN IMAGE FORMING DEVICE

(75) Inventors: Eugene David Allen, Richmond, KY (US); Brian Lester Boettcher, Versailles, KY (US); Alan Stirling Campbell, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 108 days.

(21) Appl. No.: 13/460,483

(22) Filed: Apr. 30, 2012

(65) Prior Publication Data

US 2013/0287429 A1 Oct. 31, 2013

(51) Int. Cl.
*G03G 15/08* (2006.01)

(52) U.S. Cl.
USPC ..... 399/102

(58) Field of Classification Search
CPC ..... G03G 15/0817; G03G 15/0898; G03G 21/0011
USPC ..... 399/102
See application file for complete search history.

(56) References Cited

U.S. PATENT DOCUMENTS 5,404,216 A 4/1995 Numagami et al.
5,455,665 A * 10/1995 Baba et al. ..... 399/358
6,553,195 B2 * 4/2003 Korfhage et al. ..... 399/102
6,744,999 B2 * 6/2004 Bloemen et al. ..... 399/102
2003/0059227 A1 * 3/2003 Korfhage et al. ..... 399/102
2009/0269106 A1 10/2009 Fujii
2010/0028045 A1 * 2/2010 Kawakami et al. ..... 399/123

OTHER PUBLICATIONS

Machine translation of JP 2009-162849, publication date: Jul. 23, 2009.*

International Search Report for counterpart PCT application PCT/US2013/033521, Jun. 13, 2013.

* cited by examiner

*Primary Examiner* — Walter L Lindsay, Jr.
*Assistant Examiner* — Frederick Wenderoth
(74) *Attorney, Agent, or Firm* — William F. Esser

(57) ABSTRACT

A device for cleaning a photoconductive member in an image forming device. The device includes a blade extending across the photoconductive member and having an edge that contacts a surface of the photoconductive member to remove toner therefrom. An elongated seal disposed adjacent the blade extends across a length of the blade such that an opening for receiving removed toner is formed between the elongated seal and the blade. The elongated seal includes at least one tab projecting at each longitudinal end thereof and extending between the blade and the photoconductive member so as to prevent a longitudinal end section of the edge of the blade from contacting the surface of the photoconductive member.

25 Claims, 11 Drawing Sheets

CLEANER UNIT FOR REMOVING WASTE TONER WITHIN AN IMAGE FORMING DEVICE

CROSS REFERENCES TO RELATED APPLICATIONS

Pursuant to 35 U.S.C. §119, this application claims the benefit of the earlier filing date of Provisional Application Ser. No. 61/615,188, filed Mar. 23, 2012, entitled "Cleaner Unit for Removing Waste Toner within an Image Forming Device".

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to electrophotographic imaging devices such as a printer or multifunction device having printing capability, and in particular, to a cleaner unit assembly used for cleaning a photoconductive drum.

2. Description of the Related Art

Image forming devices such as copiers, laser printers, facsimile machines, and the like, include a photoconductive drum having a rigid cylindrical surface that is coated along a defined length of its outer surface. The surface of the photoconductive drum is charged to a uniform electrical potential and then selectively exposed to light in a pattern corresponding to an original image. Those areas of the photoconductive surface exposed to light are electrically discharged thereby forming a latent electrostatic image on the photoconductive surface. A charged developer material, such as toner, is brought into contact with the photoconductive drum's surface by a developer roller such that the charged toner attaches to the discharged areas of the photoconductive surface. The toner on the photoconductive drum is then transferred onto a recording medium, such as a media sheet or a transfer belt for subsequent transfer to a media sheet.

During transfer of the toner to the recording medium, some of the toner may not be transferred and may remain on the photoconductive drum. If not removed, such residual toner may contaminate the charge roll or inadvertently transfer to a subsequent media sheet resulting in print defects. Accordingly, removal of the residual toner is necessary prior to preparing the photoconductive drum to receive a new image in order to prevent or reduce the likelihood of print defects.

In preparation for a next imaging forming cycle, the photoconductive surface may be optionally discharged and cleaned by a cleaner blade. The cleaner blade may be positioned in proximity to the photoconductive drum such that its edge contacts the photoconductive surface to wipe off residual toner therefrom. However, the cleaner blade pressed against the photoconductive drum may become damaged when operated under low lubrication. Toner acts as a lubricant which prevents friction at the cleaner blade edge from getting too high. If there is no lubrication at the cleaner blade edge, the frictional forces acting on the cleaner blade may cause the cleaner blade to flip.

The cleaner blade may extend well across the entire length of the photoconductive drum including an imaging region at a central portion and the non-imaging regions at end portions thereof. Since the non-imaging end regions of the photoconductive drum typically receive little or no toner, the end sections of the cleaner blade are more prone to low lubrication. In addition, the end sections of the cleaner blade lack stiffness relative to central portions thereof and end seals that prevent leaks at the ends of the cleaner blade press against the back side of the cleaner blade which increases the frictional force at the cleaner blade ends. As a result, cleaner blade flip typically starts at the cleaner blade ends and progresses across the full length of the cleaner blade.

Some approaches to solving cleaner blade flip problems include minimizing the length of the blade, applying lubricants to the cleaning blade itself or the photoconductive drum surface, modifying blade end sealing designs, and reducing forces applied at the ends of the cleaner blade by modifying blade support bracket designs. These methods, however, may have drawbacks in terms of cost and reliability. For example, minimizing blade width requires tight tolerances of the cleaner unit assembly which may still result in at least some level of blade end lubrication problems. Meanwhile, lubricants are typically not reliable as they are removed over the course of operation and can be subject to assembly variation when applied by human operators. End sealing design modifications, on the other hand, can act to reduce blade end forces but come at the cost of a compromise to sealing performance. Furthermore, modifying cleaner blade bracket designs to vary a load gradient across the cleaner blade adds cost and complexity to the cleaner unit assembly.

Based upon the foregoing, there is a need for a simple and a low cost solution for preventing cleaner blade failures.

SUMMARY

Embodiments of the present disclosure provide a cleaning device that mitigates cleaner blade failures by reducing or substantially eliminating friction at the ends of the cleaner blade. In an example embodiment, a device for cleaning a photoconductive member in an image forming device includes a blade extending across the photoconductive member and having an edge that contacts a surface of the photoconductive member to remove toner therefrom. The device also includes an elongated seal disposed adjacent the blade and extending across a length of the blade such that an opening for receiving removed toner is formed between the elongated seal and the blade. The elongated seal includes at least one tab projecting at each longitudinal end thereof that extends between the blade and the photoconductive member so as to prevent a longitudinal end section of the edge of the blade from contacting the surface of the photoconductive member. In this way, the end sections of the blade's edge are not subject to heightened frictional forces such that occurrences of blade flips are reduced or substantially eliminated.

In another example embodiment, an imaging unit includes a photoconductive member having respective end portions and a cleaner blade extending across the photoconductive member and contacting a surface of the photoconductive member to remove toner therefrom. A lower seal is disposed adjacent the cleaner blade and extends across the length of the cleaner blade such that an opening for capturing removed toner is formed between the cleaner blade and the lower seal. The lower seal includes first and second tabs projecting at opposite ends thereof and extending between the cleaner blade and the photoconductive member such that longitudinal end sections of the cleaner blade are prevented by the first and second tabs from contacting the surface of the photoconductive member at the respective end portions thereof.

In another example embodiment, an imaging unit includes a photoconductive member having respective end portions. A cleaner blade extends across the photoconductive member and has an edge that contacts a surface of the photoconductive member to remove toner therefrom. A lower seal is disposed adjacent the cleaner blade and extends across the length of the cleaner blade such that an opening for capturing removed toner is formed between the cleaner blade and the lower seal. At least two tabs are disposed between the cleaner blade and the photoconductive drum at opposed ends of the cleaner blade. The at least two tabs prevent longitudinal end sections of the edge of the cleaner blade from contacting the surface of the photoconductive member at the respective end portions thereof.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings, wherein.

DETAILED DESCRIPTION

Figure 1:
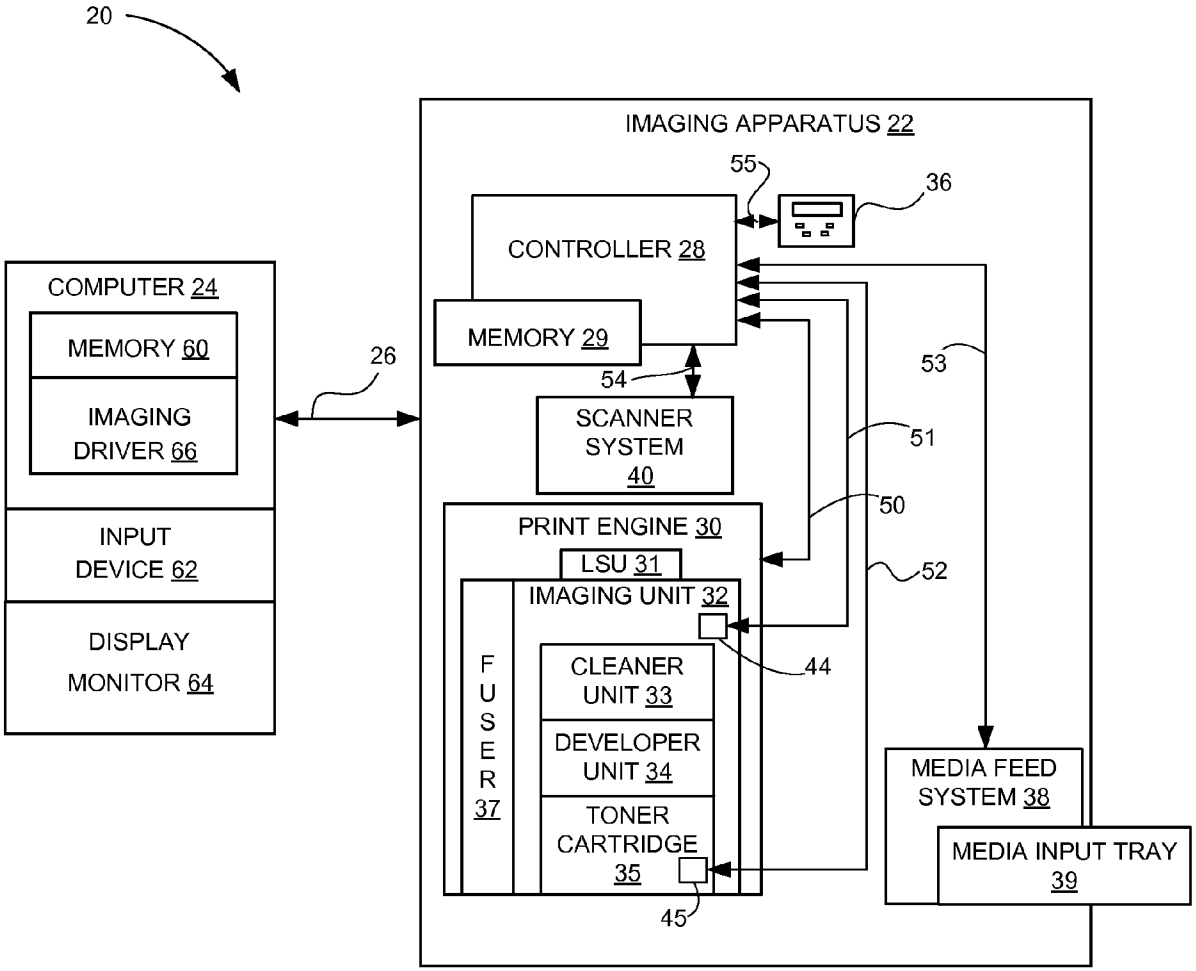
FIG. 1 is a block diagram of an example imaging system utilizing the imaging unit of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

In FIG. 1, there is shown a diagrammatic depiction of an imaging system 20 embodying the present disclosure. As shown, imaging system 20 may include an imaging apparatus 22 and a computer 24. Imaging apparatus 22 communicates with computer 24 via a communications link 26. As used herein, the term "communications link" is used to generally refer to any structure that facilitates electronic communication between multiple components, and may operate using wired or wireless technology and may include communications over the Internet.

In the embodiment shown in FIG. 1, imaging apparatus 22 is shown as a multifunction machine that includes a controller 28, a print engine 30, a laser scan unit (LSU) 31, an imaging unit 32, a developer unit 34, a toner cartridge 35, a user interface 36, a media feed system 38 and media input tray 39, and a scanner system 40. Imaging apparatus 22 may communicate with computer 24 via a standard communication protocol, such as for example, universal serial bus (USB), Ethernet or IEEE 802.xx. A multifunction machine is also sometimes referred to in the art as an all-in-one (AIO) unit. Those skilled in the art will recognize that imaging apparatus 22 may be, for example, an electrophotographic printer/copier including an integrated scanner system 40 or a standalone scanner system 40.

Controller 28 includes a processor unit and associated memory 29, and may be implemented as one or more Application Specific Integrated Circuits (ASICs). Memory 29 may be any volatile and/or non-volatile memory such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the present embodiment, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 therein via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuit 44, 45 may provide authentication functions, safety and operational interlocks, operating parameters and usage information related to imaging unit 32 and toner cartridge 35, respectively. Controller 28 serves to process print data and to operate print engine 30 during printing, as well as to operate scanner system 40 and process data obtained via scanner system 40.

Computer 24, which may be optional, may be, for example, a personal computer, electronic tablet, smartphone or other hand-held electronic device, including memory 60, such as volatile and/or non-volatile memory, an input device 62, such as a keyboard or keypad, and a display monitor 64. Computer 24 further includes a processor, input/output (I/O) interfaces, and may include at least one mass data storage device, such as a hard drive, a CD-ROM and/or a DVD unit (not shown).

Computer 24 includes in its memory a software program including program instructions that function as an imaging driver 66, e.g., printer/scanner driver software, for imaging apparatus 22. Imaging driver 66 is in communication with controller 28 of imaging apparatus 22 via communications link 26. Imaging driver 66 facilitates communication between imaging apparatus 22 and computer 24. One aspect of imaging driver 66 may be, for example, to provide formatted print data to imaging apparatus 22, and more particularly, to print engine 30, to print an image. Another aspect of imaging driver 66 may be, for example, to facilitate collection of scanned data.

In some circumstances, it may be desirable to operate imaging apparatus 22 in a standalone mode. In the standalone mode, imaging apparatus 22 is capable of functioning without computer 24. Accordingly, all or a portion of imaging driver 66, or a similar driver, may be located in controller 28 of imaging apparatus 22 so as to accommodate printing and scanning functionality when operating in the standalone mode.

Print engine 30 may include laser scan unit (LSU) 31, imaging unit 32, and a fuser 37, all mounted within imaging apparatus 22. The imaging unit 32 further includes a cleaner unit 33 housing a waste toner removal system and a photoconductive drum and developer unit 34 which is removably mounted within print engine 30 of imaging apparatus 32. In one embodiment, the cleaner unit 33 and developer unit 34 are assembled together and installed onto a frame of the imaging unit 32. The toner cartridge 35 is then installed on or in proximity with the frame in a mating relation with the developer unit 34. Laser scan unit 31 creates a latent image on the photoconductive drum in the cleaner unit 33. The developer unit 34 has a toner sump containing toner which is transferred to the latent image on the photoconductive drum to create a toned image. The toned image is subsequently transferred to a media sheet received in the imaging unit 32 from media input tray 39 for printing. Toner remnants are removed from the photoconductive drum by the waste toner removal system. The toner image is bonded to the media sheet in the fuser 37 and then sent to an output location or to one or more finishing options such as a duplexer, a stapler or hole punch.

Figure 2:
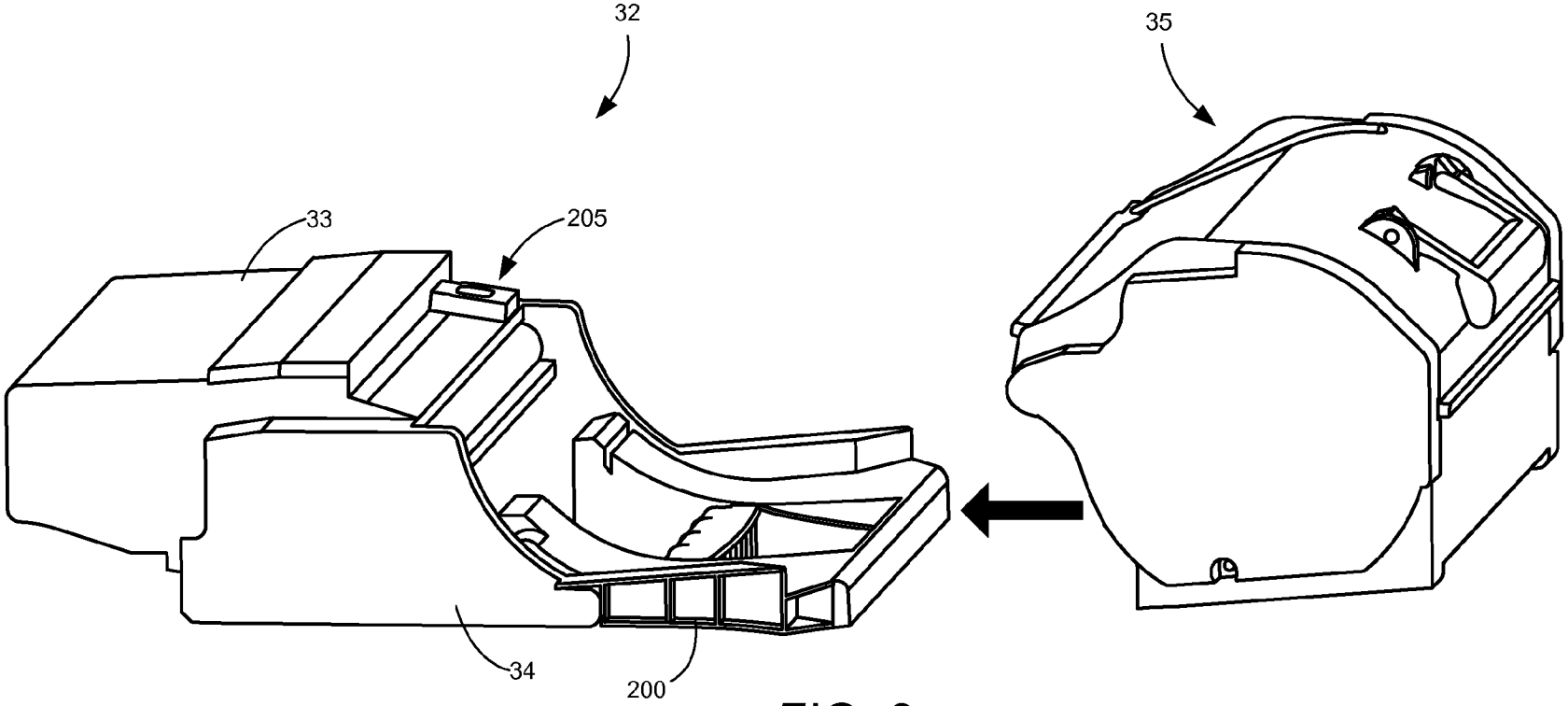
FIG. 2 is a perspective view of an imaging unit and toner cartridge of FIG. 1 in accordance with an example embodiment.

Referring now to FIG. 2, an example embodiment of imaging unit 32 is shown. Imaging unit 32, as illustrated, includes developer unit 34, cleaner unit 33 and a frame 200. Developer unit 34 and cleaner unit 33 are assembled onto or otherwise secured to frame 200. The imaging unit 32 without toner cartridge 35 is initially slidably received into imaging apparatus 22. The toner cartridge 35 is then slidingly inserted along frame 200 until it is operatively coupled to developer unit 34. This arrangement allows toner cartridge 35 to be separately removed and reinserted easily when replacing an empty toner cartridge or during media jam removal. The developer unit 34, cleaning unit 33 and frame 200 may also be readily slidingly removed and reinserted as a single unit when required. However, this would normally occur with less frequency than the removal and reinsertion of toner cartridge 35.

As mentioned, the toner cartridge 35 removably mates with the developer unit 34 of imaging unit 32. An exit port (not shown) on the toner cartridge 35 communicates with an inlet port 205 on the developer unit 34 allowing toner to be periodically transferred from the toner cartridge 35 to resupply the toner sump in the developer unit 34.

Figure 3:
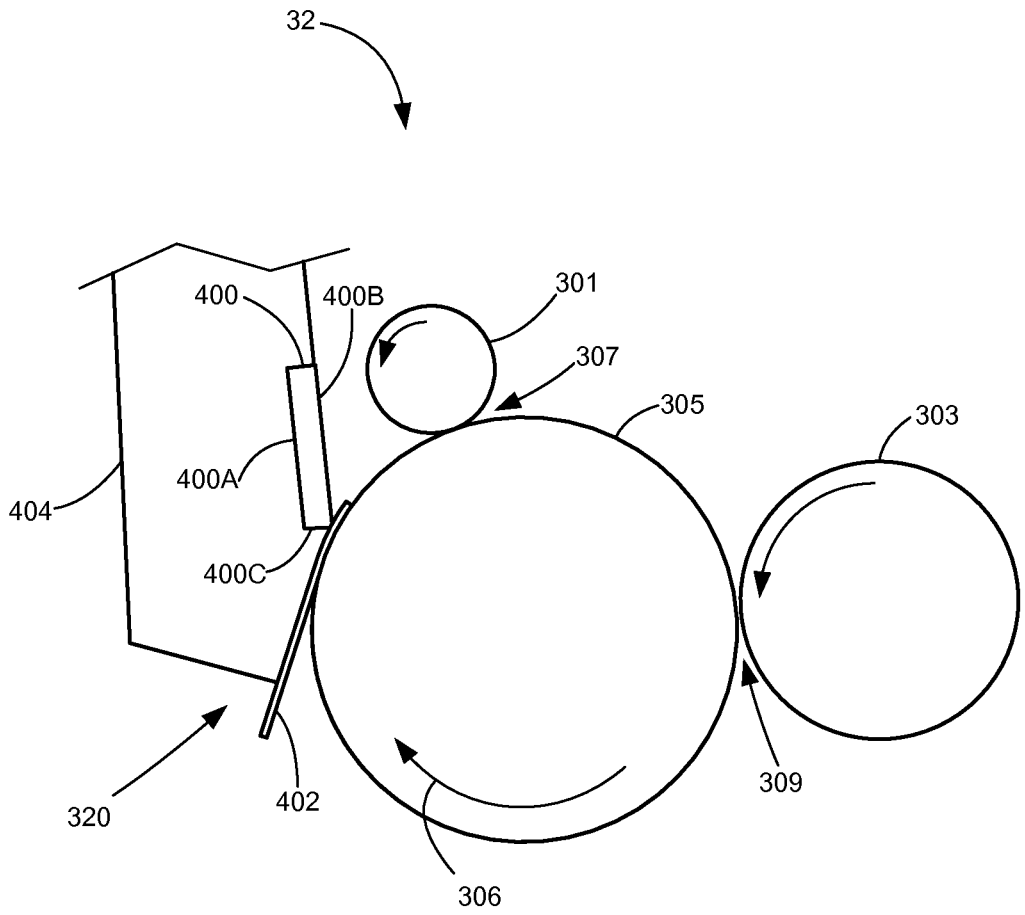
FIG. 3 is a simplified sectional view of a portion of the imaging unit of FIG. 2 according to an example embodiment.

FIG. 3 illustrates a simplified sectional view of at least a portion of imaging unit 32 according to an example embodiment. As shown in FIG. 3, imaging unit 32 includes a charge roller 301, developer roller 303, and photoconductive drum 305. The charge roller 301 forms a nip 307 with the photoconductive drum 305 and charges the surface thereof to a specified voltage. A laser beam from the LSU 31 strikes the surface of the photoconductive drum 305 and discharges those areas it illuminates to form a latent image. The developer roller 303, which also forms a nip 309 with the photoconductive drum 305, transfers toner particles from a toner reservoir or sump (not shown) to areas of the photoconductive drum 305 surface discharged by the laser beam to form a toner image. The toner image on the photoconductive drum 305 may then be transferred to a media sheet that is moved to be in contact with the surface of the photoconductive drum 305. Alternatively, a transfer belt (not shown) may be used to collect the toner image from the photoconductive drum 305 at a first transfer area and convey the toner image to a media sheet at a second transfer area.

Cleaner unit 33 of imaging unit 32 may include a cleaning assembly 320 for removing residual toner that remains on the photoconductive drum 305 after the transfer of the toner image to the media sheet or transfer belt. Cleaning assembly 320 may be positioned to contact the surface of the photoconductive drum 305 to remove residual toner therefrom.

Figure 4:
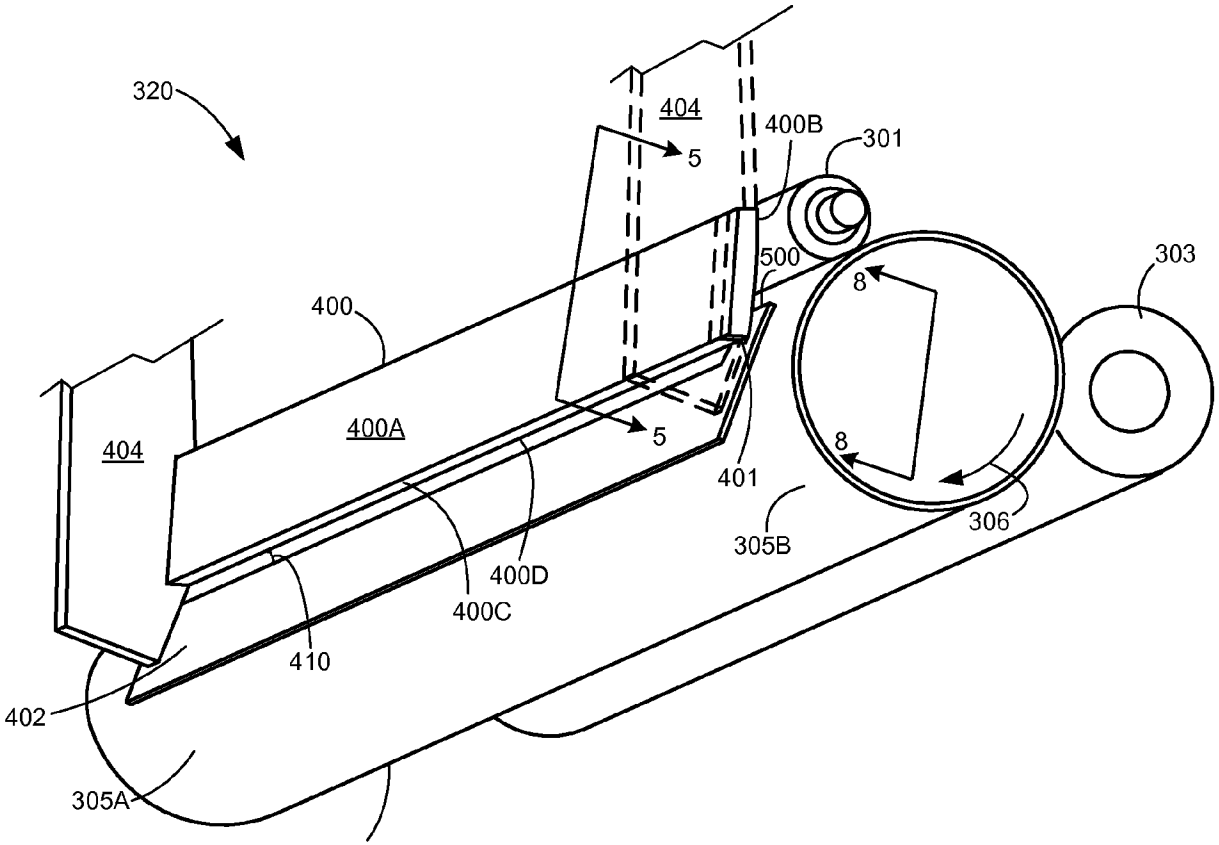
FIG. 4 illustrates a cleaning unit assembly of the imaging unit of FIG. 3 according to an example embodiment.

Referring to FIGS. 3 and 4, cleaning assembly 320 may include a cleaner blade 400, a lower seal 402, and end seals 404. The cleaner blade 400 generally extends from a first end portion 305A to a second end portion 305B of the photoconductive drum 305 and has front surface 400A, a back surface 400B, a bottom surface 400C and a cleaning edge 400D that abuts against the surface of the photoconductive drum 305. The ends of the cleaner blade 400 may be offset from the first end portion 305A and the second end portion 305B of the photoconductive drum 305, such as by about 10 mm. The cleaner blade 400 may be made from any suitable resilient material, such as urethane or polyurethane. The cleaner blade 400 may be held in place by a bracket (not shown) mounted to the housing of the imaging unit 32, or by any means known in the art. Lower seal 402 may extend across the length of the photoconductive drum 305 and may be disposed adjacent the cleaning edge 400D such that a rectangular opening 410 is formed between the lower seal 402 and the cleaner blade 400 for capturing residual toner removed from the surface of the photoconductive drum 305 by the cleaning edge 400D. The opening 410 may lead into a waste toner reservoir (not shown) in cleaner unit 33 for storing the waste toner. The end seals 404 may be disposed proximate the respective end portions 305A and 305B of the photoconductive drum and may contact at least a portion of each of the front surface 400A, bottom surface 400C, and lower seal 402 to prevent toner escape around the ends of the photoconductive drum 305.

As described above, respective longitudinal end sections 401 of the cleaning edge 400D are more susceptible to blade flips because of lack of lubrication and increased friction due to additional forces introduced by the ends seals 404 that may cause the end sections 401 of the cleaning edge 400D to catch onto the rotating photoconductive drum 305 and follow same, thereby flipping the blade end sections 401. Once a blade flip starts at the end sections 401 of the cleaning edge 400D, the blade flip may then progress across the full length of the cleaner blade 400 until the cleaner blade 400 is fully flipped.

According to example embodiments of the present disclosure, blade flips may be mitigated by at least partially eliminating friction between the cleaner blade 400 and the photoconductive drum 305 at their respective ends. According to the example embodiment shown in FIGS. 3 and 4, a thin strip, flap or tab 500 may be disposed between the cleaner blade 400 and the photoconductive drum 305 at each of their respective ends to prevent the end sections 401 of the cleaning edge 400D from contacting the surface of the photoconductive drum 305 proximate the end portions 305A and 305B. Each of the tabs 500 may be about 4 mm to about 5 mm wide and may nominally cover at least about 3 mm of the cleaning edge 400D end sections 401. Tabs 500 may be made of any relatively firm low friction material, such as Mylar. In this way, substantially no friction is created at the end sections 401 of cleaning edge 400D since there is no relative motion between the cleaning edge 400D end sections 401 and the tabs 500 such that likelihood for a blade flip to occur may be decreased.

Figure 5:
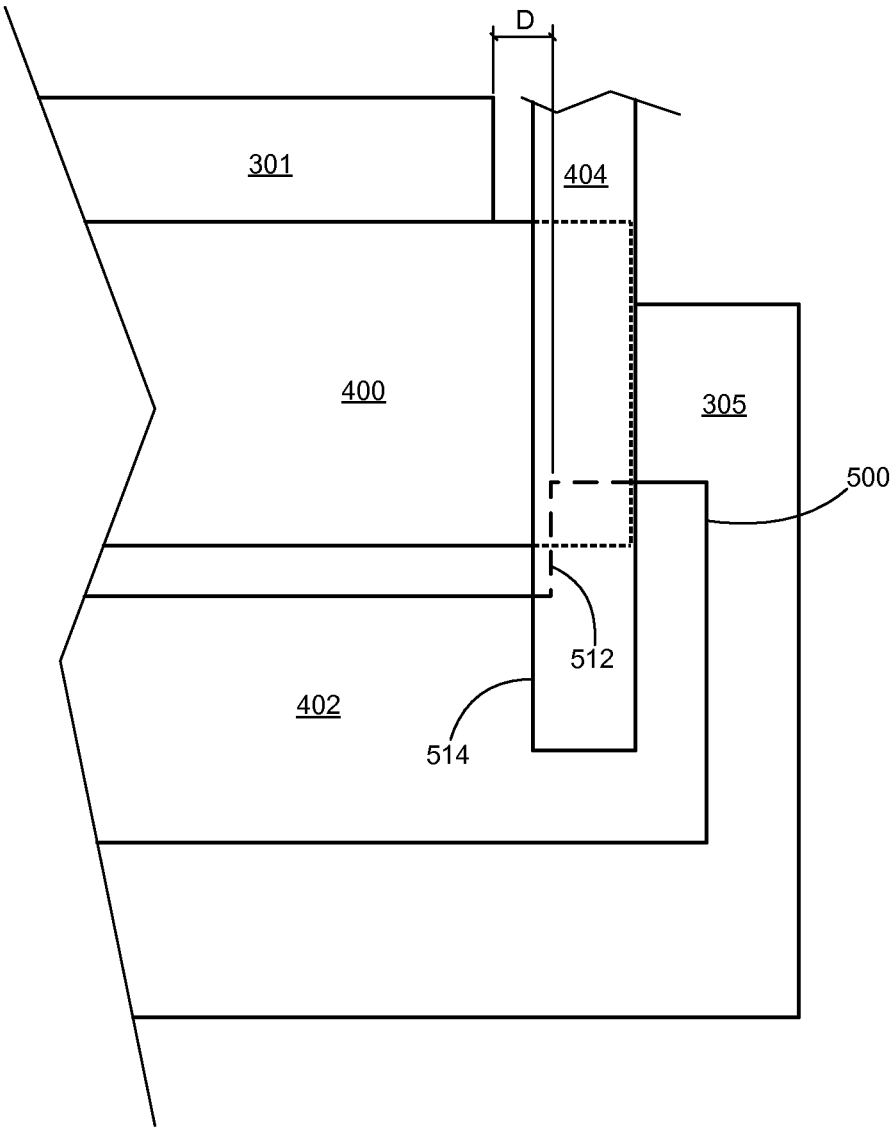
FIG. 5 illustrates a fragmented view of the lower seal in FIG. 4 taken along line 5-5 therein, in conjunction with a photoconductive drum, a charge roller and an end seal.

FIG. 5 illustrates the lower seal 402 relative to the photoconductive drum 305, end seals 404, and charge roller 301 as viewed facing the front surface 400A of the cleaner blade 400 in FIG. 4. As shown, the end seals 404 overlap with at least portions of the widths of the tabs 500 and the cleaner blade 400. In one embodiment, inside edges 512 of the tabs 500, relative to a central portion of the photoconductive drum 305, may be positioned slightly outside inner edges 514 of the end seals 404 relative to the longitudinal center of the photoconductive drum 305. The arrangement may enable the pressure of the end seals 404 against the cleaner blade 400 to reduce the tendency for leaks at the holes or gaps formed where the cleaning edge 400D goes over the tabs 500 and to restrict toner leak at the inside edges 512 of the tabs 500. In one embodiment, the inside edges 512 of the tabs 500 may be offset by about 1.3 mm from the inner edges 514 of the end seals 404. In an alternative embodiment, the inside edges 512 of the tabs 500 may substantially align with the inner edges 514 of the end seals 404. In another alternative embodiment, the inside edges 512 may be positioned inside the inner edges 514 of the end seals 404 relative to the longitudinal center of the photoconductive drum 305.

As the photoconductive drum 305 rotates, the inside edges 512 of the tabs 500 may create relatively deep scratches or form wear rings on the surface coating of the photoconductive drum 305 that may extend around its entire circumference. If the charge roller 301 contacts the wear rings, a short circuit may occur. To prevent a short circuit from occurring, the inside edges 512 of the tabs 500 may be positioned outside the surface of the photoconductive drum 305 that contacts and is charged by the charge roller 301. As shown in FIG. 5, the inside edges 512 of the tabs 500 are spaced apart from the ends of the charge roller by a distance D.

Figure 6:
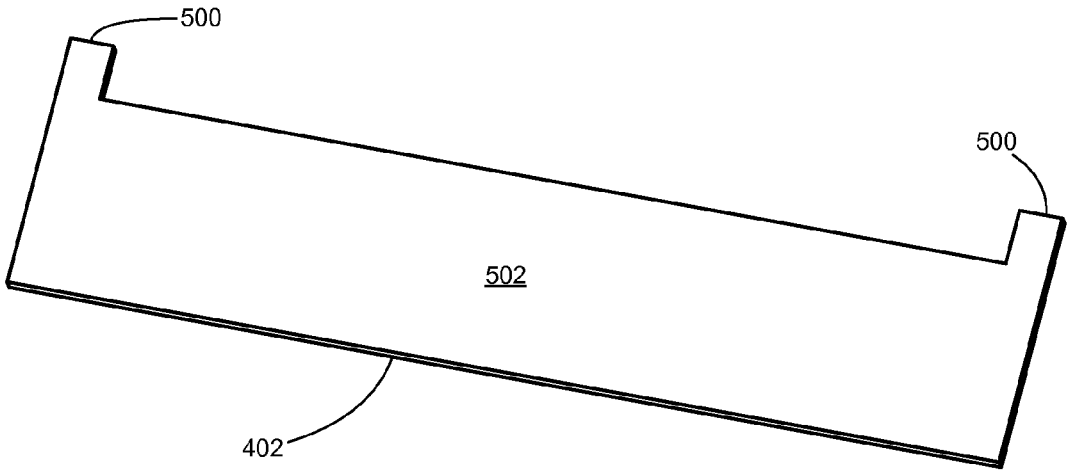
FIG. 6 illustrates a lower seal of the cleaning unit assembly in FIG. 4.

FIG. 6 shows the tabs 500 in FIG. 4 being rectangular in shape and integrally formed as a unitary piece with the lower seal 402 so as to form a substantially U-shaped structure. As shown, tabs 500 extend from elongated section 502 at longitudinal ends thereof. The tabs 500 project from the lower seal 402 and extend between the cleaner blade 400 and the photoconductive drum 305.

Figure 7:
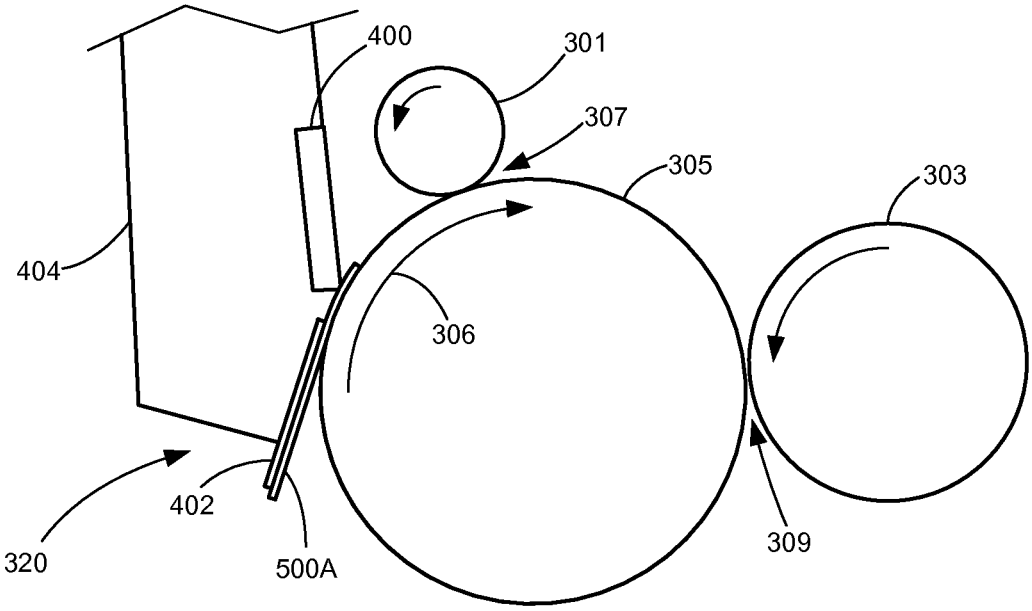
FIG. 7 is a simplified sectional view of a portion of the imaging unit of FIG. 2 according to another example embodiment.

In another example embodiment, the tabs 500 may be separate strips or tabs that are coupled and/or attached to the ends of the lower seal 402 and/or end seals 404. In other example embodiments, tabs 500 may be integrally formed as a unitary piece with the end seals 404. As shown for example in FIG. 7, tabs 500A may be disposed below lower seal 402 and arranged to prevent contact between end sections 401 of the cleaning edge 400D and the surface of the photoconductive drum 305 proximate the end portions thereof. End seals 404 may contact at least portions of tabs 500A between the cleaning edge 400D and the lower seal 402 to prevent toner escape around the ends of the photoconductive drum 305.

Figure 8:
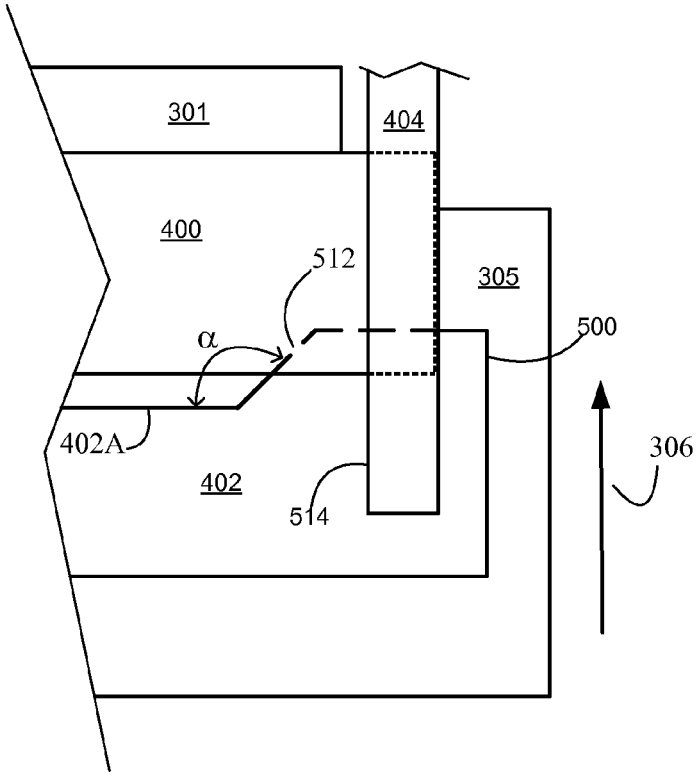
FIG. 8 illustrates a fragmented view of a lower seal according to another example embodiment taken along the line 5-5 of FIG. 4, in conjunction with a photoconductive drum, a charge roller and an end seal.

In another example embodiment, tabs 500 may have a different form or shape. For example, FIG. 8 illustrates tabs 500 extending from lower seal 402 and including an inner edge 512 that is angled Inner edge 512 may form an obtuse angle $\alpha$ with a trailing edge 402A of lower seal 402. In an example embodiment, angle $\alpha$ is not orthogonal with trailing edge 402A and may be greater than about 90 degrees and less than about 140 degrees Inner edge 512 may also be seen as forming a non-zero angle with a direction of rotation 306 of the photoconductive drum 305. As shown in FIG. 8, inner edge 512 of tab 500 may appear wholly inside the inner edge of end seal 404. Alternatively, it is understood that at least a portion of inner edge 512 may be located under end seal 404. With tension existing between the photoconductive drum 305 and lower seal 402, the angled inner edge 512 of tabs 500 results in a substantially continuous seal between lower seal 402, tabs 500 and photoconductive drum 305. The angled inner edge 512 also advantageously allows for a wider distribution of wear along photoconductive drum 305 due to contact with lower seal 402 and tabs 500.

Figure 9:
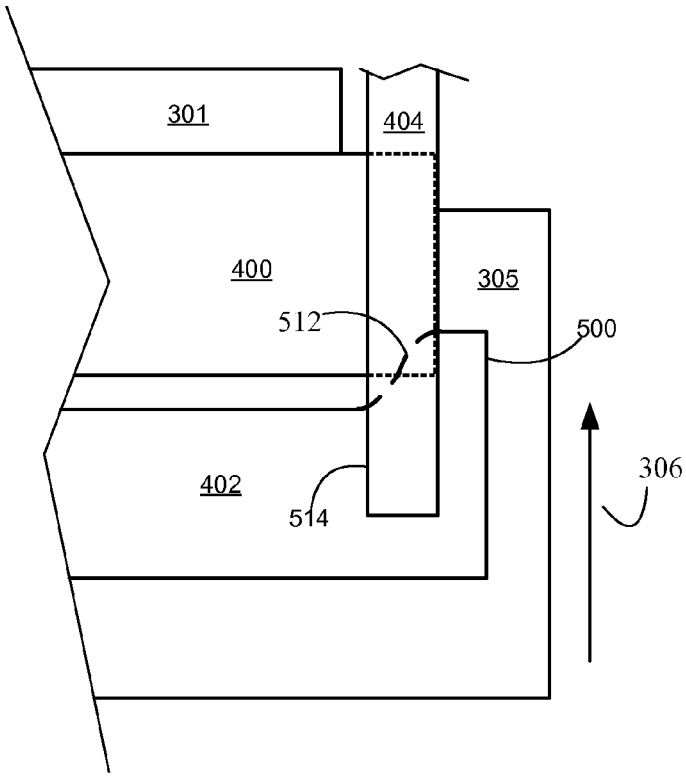
FIG. 9 illustrates a fragmented view of a lower seal according to another example embodiment taken along the line 5-5 of FIG. 4, in conjunction with a photoconductive drum, a charge roller and an end seal.

The example embodiment of FIG. 8 illustrates inner edge 512 being substantially linear. It is understood that inner edge 512 may have a nonlinear shape, such as a curved contour. FIG. 9 illustrates another example embodiment in which inner edge 512 of tabs 500 is curved. FIG. 9 further illustrates that inner edge 512 of tabs 500 may be located substantially entirely under end seal 402.

Figure 10:
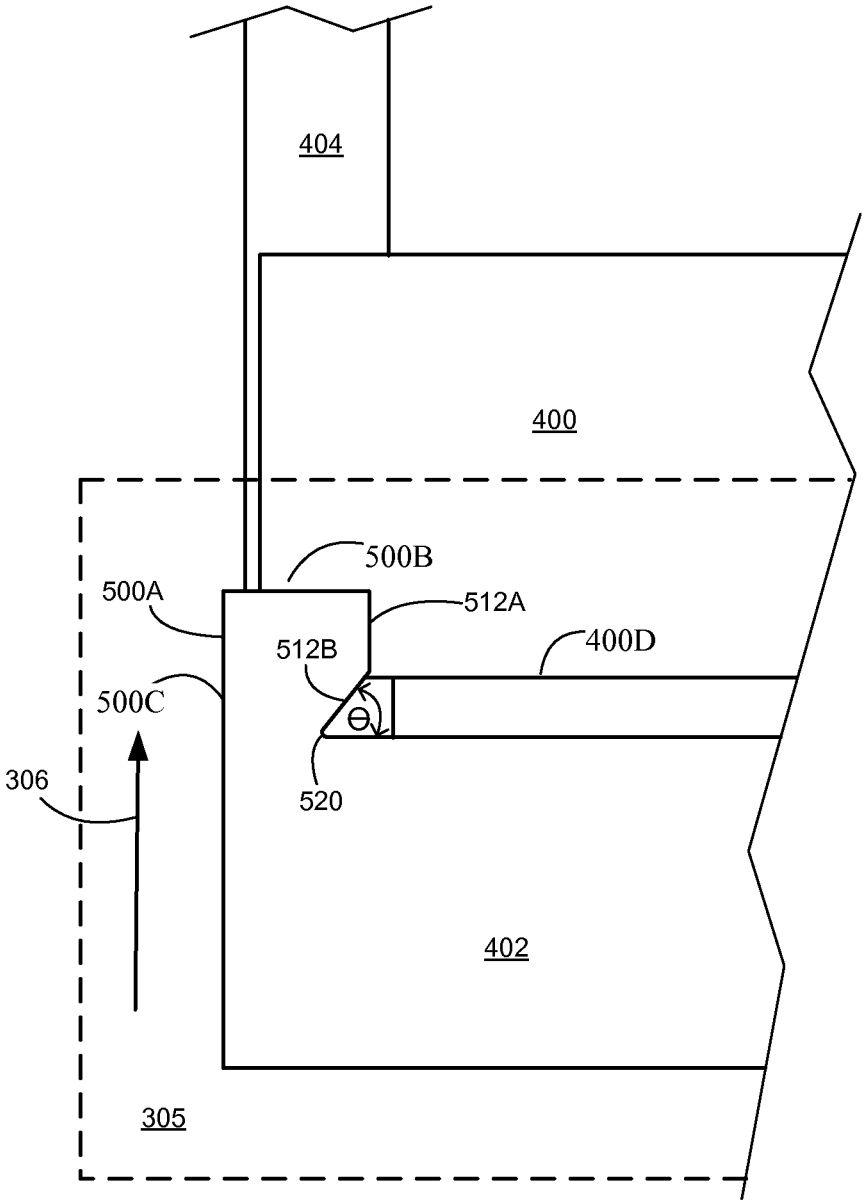
FIG. 10 illustrates a fragmented view of another example embodiment of a lower seal for the cleaning unit assembly of FIG. 4 taken along line 8-8 therein, in conjunction with a photoconductive drum, a cleaner blade and an end seal.

In another example embodiment, tabs 500 may have a different form or shape. For example, FIG. 10 shows another example embodiment of tabs 500 for the cleaning unit assembly of FIG. 4 taken along line 8-8 therein. As shown, lower seal 402 may include each tab 500A having an upper inside edge section 512A that is substantially perpendicular to the cleaning edge 400D (as well as the edge 500B of tab 500A), and an angled inside edge section 512B that is sloped from the lower end of upper inside edge section 512A towards edge 500C of tab 500A. The upper inside edge section 512A may be located along photoconductor drum 305 substantially downstream from the cleaning edge 400D while the angled inside edge section 512B may be located along photoconductor drum 305 substantially upstream from the cleaning edge 400D, relative to the direction of rotation 306 of the photoconductive drum 305. The angled inside edge section 512B may be sloped in a direction that encourages toner near the end of the photoconductive drum 305 to move towards the cleaning edge 400D. As such, angled inside edge sections 512B at opposed ends of the lower seal 402 may be sloped in opposite directions. The angled inside edge section 512B may direct toner that escapes the cleaning edge 400D in the area of end seal 404, such as toner particles within the vicinity of ending 520 of tab 500A, towards the cleaning edge 400D contacting photoconductive drum 305 as the photoconductive drum 305 rotates, and prevent toner rings from forming at the ends of the photoconductive drum 305 as a result. In an example embodiment, angled inside edge section 512B may form an angle θ with the lower seal 402 that is less than 90°, such as between about 35° and about 65°.

Figure 11A:
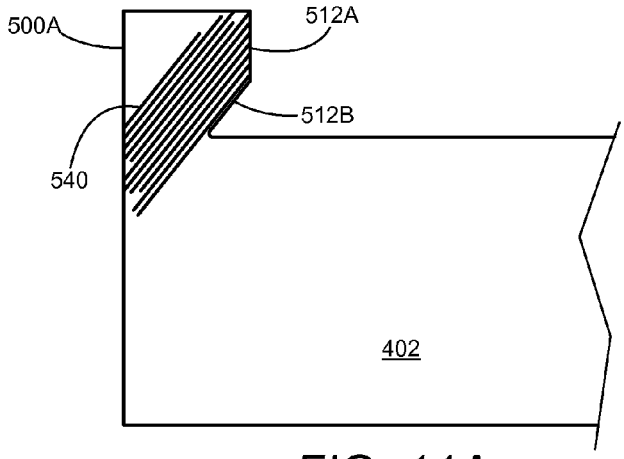
FIGS. 11A-11C illustrate other example embodiments of the lower seal in FIG. 10.
Figure 11B:
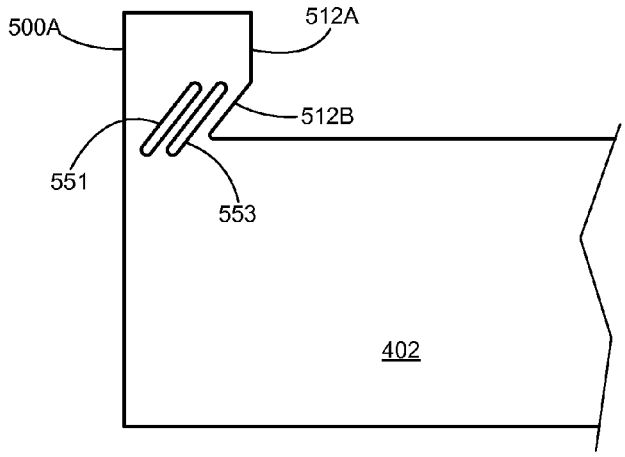
Figure 11C:
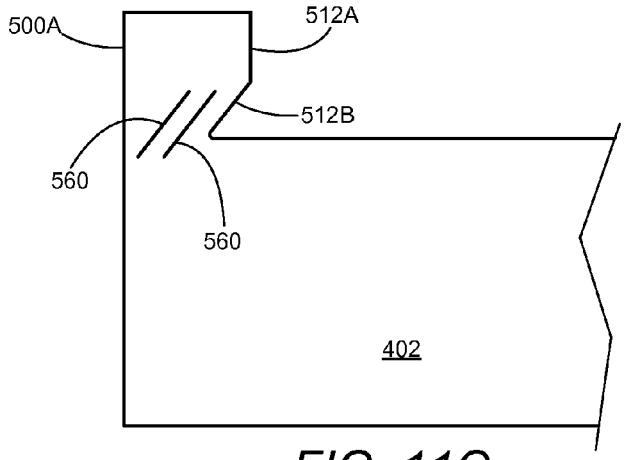

In other alternative embodiments, tab 500A may include features that may direct toner to the photoconductive drum 305, such as toner particles that pass directly underneath the bottom surface of the tab 500A facing and abutting against the surface of the photoconductive drum 305, towards a cleaning region where they may be redirected by the angled inside edge section 512B towards the cleaning edge 400D for removal from the surface of the photoconductive drum 305, as shown in FIGS. 11A-11C.

In FIG. 11A, the bottom surface of tab 500A adjacent photoconductive drum 305 includes a plurality of ridges or scores 540 that capture toner near the end of the lower seal 402 and dislodge the captured toner at areas of the photoconductive drum 305 adjacent the angled inside edge section 512B or upper inside edge section 512A. Toner particles dislodged at the angled inside edge section 512B may be directed towards the cleaning edge 400D by the angled inside edge section 512B via the rotation of photoconductive drum 305. On the other hand, toner particles dislodged at the upper inside edge section 512A may be deposited downstream from the cleaning edge 400D and thus may have to rotate around the circumference of the photoconductive drum 305 before being removed by cleaning edge 400D. It is also understood that toner particles may not necessarily return to the cleaning edge 400D after one revolution of the photoconductive drum 305 and instead may be moved incrementally towards cleaning edge 400D with each subsequent rotation of the photoconductive drum 305.

In another alternative embodiment, tab 500A may include one or more cutout sections or slots extending through tab 500A that may create passageways for escaped toner to move back into the cleaning region. In FIG. 11B, each tab 500A may include a first slot 551 and a second slot 553. First and second slots 551 and 553 may be sloped in a direction substantially parallel to the angled inside edge section 512B. An upper segment of the first slot 551 may overlap with a lower segment of an adjacent second slot 553 while an upper segment of the second slot 553 may overlap with a lower segment of angled inside edge section 512B. Toner particles that are moved to the upper segment of the first slot 551 upon rotation of the photoconductive drum 305 may be picked up by the surface of the photoconductive drum 305 and then later enter the lower segment of the second slot 553 after at least one revolution of the photoconductive drum 305. During continued rotation of photoconductive drum 305, the toner particles that subsequently enter the lower segment of the second slot 553 may then move to an upper segment of the second slot 553, subsequently engage with the lower segment of angled inside edge section 512B and thereby move towards the cleaning edge 400D for removal. It is understood that such toner movement from slot 551 to cleaning edge 400D via slot 553 and angled inside edge section 512B may occur incrementally during a number of revolutions of photoconductive drum 305.

Though FIG. 11B illustrates two slots 551, 553, it is understood that tab 500A may include more than two slots.

Alternatively, each tab 500A may include slits 560 extending through the tab 500A, as shown in FIG. 11C. Unlike first and second slots 551 and 553 in FIG. 11B, slits 560 are formed without creating waste material, such as punched chads, during a punching process. Slits 560 may have similar lengths, angular positioning and functional purpose as those of the first and second slots 551 and 553 in FIG. 11B. It is understood that tab 500A may include more than two slits.

Figure 12:
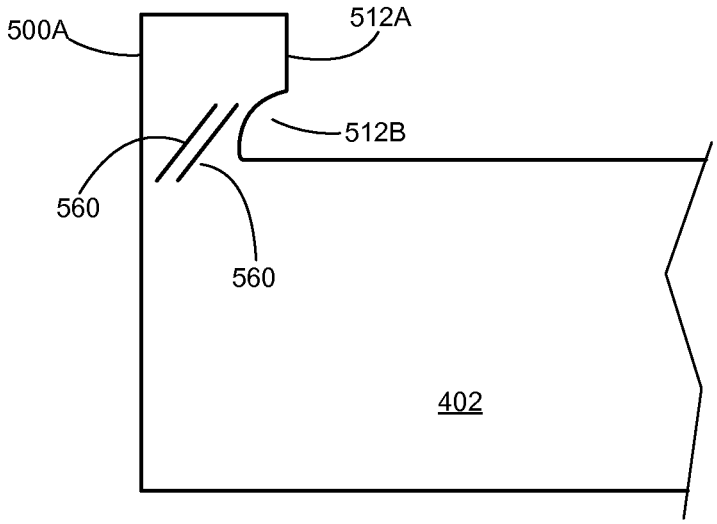
FIG. 12 illustrates another example embodiment of the lower seal in FIG. 4.

It is contemplated that the tabs 500 and 500A may be of other various geometrical shapes or profiles and may be of different lengths and/or dimensions or angular orientations as would occur to those skilled in the art. For example, FIG. 12 shows tab 500A having a contoured inside edge section 512C. Further, it is also understood that the angled inside edge section 512B, contoured inside edge section 512C, scores 540, slots 551 and 553, and slits 560 may be implemented for the tabs 500 individually or in various combinations.

It is understood that the cleaner assembly as described above can be utilized to remove residual waste toner from a photoconductive drum of an imaging device irrespective of the particular architecture selected for the toner cartridge, developer unit and photoconductive unit. For example, the cleaner assembly may be used in a removable imaging unit, such as imaging unit 32, as well as a removable toner cartridge unit that includes a charge roll and photoconductive drum.

The description of the details of the example embodiments have been described using the cleaning unit assembly for the photoconductive drum. However, it will be appreciated that the teachings and concepts provided herein are applicable to other residual and/or waste toner removal systems as well.

The foregoing description of several methods and example embodiments has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A removable unit for an imaging device, comprising:

a photoconductive member having respective end portions;

a cleaner blade extending across the photoconductive member and having an edge contacting a surface of the photoconductive member to remove toner therefrom; and a lower seal disposed adjacent the cleaner blade and extending across a length of the cleaner blade such that an opening for capturing removed toner is formed between the cleaner blade and the lower seal, the lower seal including first and second tabs projecting at opposite ends thereof and extending between the cleaner blade and the photoconductive member such that longitudinal end sections of the cleaner blade are prevented by the first and second tabs from contacting the surface of the photoconductive member at the respective end portions thereof, wherein at least one of the first and second tabs includes an angled inside edge located upstream from the edge of the cleaner blade relative to a direction of rotation of the photoconductive member, the angled inside edge being at one of an acute angle, an obtuse angle and an orthogonal angle relative to a trailing edge of the lower seal.

2. The removable unit of claim 1, further comprising first and second end seals disposed at the respective end portions of the photoconductive member and biased to contact the cleaner blade and the lower seal to prevent toner escape, the first and second end seals overlapping a portion of the first and second tabs, respectively.

3. The removable unit of claim 2, wherein the first and second tabs have inside edges and the first and second end seals have inner edges, the inside edges of the first and second tabs disposed outside of the inner edges of the first and second end seals, relative to a longitudinal center of the photoconductive member.

4. The removable unit of claim 2, wherein the first and second tabs have inside edges and the first and second end seals have inner edges, the inside edges of the first and second tabs being substantially aligned with the inner edges of the first and second end seals.

5. The removable unit of claim 2, wherein the first and second tabs have inside edges and the first and second end seals have inner edges, the inside edges of the first and second tabs located offset from the inner edges of the first and second end seals.

6. The removable unit of claim 1, wherein the at least one of the first and second tabs includes a contoured inside edge portion.

7. The removable unit of claim 1, wherein the at least one of the first and second tabs includes a plurality of ridges formed at respective bottom surfaces thereof contacting the photoconductive member, the plurality of ridges capturing toner particles near an end portion of the photoconductive member and dislodging the toner particles at areas of the surface of the photoconductive member contacted by the edge of the cleaner blade.

8. The removable unit of claim 1, wherein the at least one of the first and second tabs includes one or more cut sections extending through the tab, the one or more cut sections creating passageways for the toner particles near an end portion of the photoconductive member to move toward the edge of the cleaner blade contacting the photoconductive member.

9. A removable unit for an imaging device, comprising:

a photoconductive member having respective end portions;

a cleaner blade extending across the photoconductive member and having an edge that contacts a surface of the photoconductive member to remove toner therefrom;

a lower seal disposed adjacent the cleaner blade and extending across the length of the cleaner blade such that an opening for capturing removed toner is formed between the cleaner blade and the lower seal; and at least two tabs disposed between the cleaner blade and the photoconductive drum at opposed ends of the cleaner blade, the at least two tabs preventing longitudinal end sections of the edge of the cleaner blade from contacting the surface of the photoconductive member at the respective end portions thereof;

wherein the at least two tabs include one or more angled inside edges located upstream from the edge of the cleaner blade relative to a direction of rotation of the photoconductive member, the one or more angled inside edges being at least one of an acute angle, an obtuse angle and an orthogonal angle relative to a trailing edge of the lower seal.

10. The removable unit of claim 9, wherein the at least two tabs are elongated strips projecting from opposite ends of the lower seal towards the cleaner blade.

11. The removable unit of claim 9, further comprising first and second end seals disposed at the respective end portions of the photoconductive member and biased to contact the cleaner blade, the lower seal, and the at least two tabs to prevent toner escape, the first and second end seals respectively overlapping a width of the at least two tabs.

12. The removable unit of claim 11, wherein the at least two tabs have inside edges and the first and second end seals have inner edges, the inside edges of the at least two tabs disposed outside of the inner edges of the first and second end seals, relative to a longitudinal center of the photoconductive member.

13. The removable unit of claim 11, wherein the at least two tabs have inside edges and the first and second end seals have inner edges, the inside edges being substantially aligned with the inner edges.

14. The removable unit of claim 11, wherein the at least two tabs have inside edges and the first and second end seals have inner edges, the inside edges of the at least two tabs located offset from the inner edges of the first and second end seals.

15. The removable unit of claim 9, wherein the at least two tabs include a plurality of ridges formed at surfaces adjacent the photoconductive member, the plurality of ridges dislodging toner particles near the respective end portions of the photoconductive member at areas of a surface of the photoconductive member contacted by the edge of the cleaner blade.

16. The removable unit of claim 9, wherein the at least two tabs include one or more cut sections extending through the at least two tabs, the one or more cut sections creating passageways for toner particles near the respective end portions of the photoconductive member to move toward the edge of the cleaner blade contacted by the photoconductive member.

17. The removable unit of claim 16, wherein the one or more cut sections comprise one or more of at least one slot and at least one slit defined through the at least two tabs.

18. A device for cleaning a photoconductive member in an image forming device, the device comprising:

a blade extending across the photoconductive member and having an edge that contacts a surface of the photoconductive member to remove toner therefrom; and an elongated seal disposed adjacent the blade and extending across a length of the blade such that an opening for receiving removed toner is formed between the elongated seal and the blade, the elongated seal including at least one tab projecting at at least one longitudinal end thereof and extending between the blade and the photoconductive member so as to prevent a longitudinal end section of the edge of the blade from contacting the surface of the photoconductive member, wherein the at least one tab includes an angled inside edge located upstream from the edge of the cleaner blade relative to a direction of rotation of the photoconductive member, the angled inside edge being at one of an acute angle, an obtuse angle and an orthogonal angle relative to a trailing edge of the elongated seal.

19. The device of claim 18, wherein the at least one tab includes one or more of at least one ridge, at least one slot and at least one slit disposed at an angle to the edge of the cleaner blade, to move toner particles towards a portion of the edge of the cleaner blade that contacts the photoconductive member.

20. The device of claim 18, wherein the at least one tab includes a nonlinear inside edge portion.

21. A removable unit for an imaging device, comprising:

a photoconductive member having respective end portions;

a cleaner blade extending across the photoconductive member and having an edge contacting a surface of the photoconductive member to remove toner therefrom; and a lower seal disposed adjacent the cleaner blade and extending across a length of the cleaner blade such that an opening for capturing removed toner is formed between the cleaner blade and the lower seal, the lower seal including first and second tabs projecting at opposite ends thereof and extending between the cleaner blade and the photoconductive member such that longitudinal end sections of the cleaner blade are prevented by the first and second tabs from contacting the surface of the photoconductive member at the respective end portions thereof, wherein at least one of the first and second tabs includes a contoured inside edge.

22. A device for cleaning a photoconductive member in an image forming device, the device comprising:

a blade extending across the photoconductive member and having an edge that contacts a surface of the photoconductive member to remove toner therefrom; and an elongated seal disposed adjacent the blade and extending across a length of the blade such that an opening for receiving removed toner is formed between the elongated seal and the blade, the elongated seal including at least one tab projecting at at least one longitudinal end thereof and extending between the blade and the photoconductive member so as to prevent a longitudinal end section of the edge of the blade from contacting the surface of the photoconductive member, wherein the at least one tab includes a nonlinear inside edge.

23. The device of claim 18, further comprising first and second end seals disposed at respective end portions of the photoconductive member and biased to contact the blade, the elongated seal, and the at least one tab to prevent toner escape, wherein each of the at least one tab at the at least one longitudinal end of the elongated seal has an inside edge and the first and second end seals have inner edges, the inside edges of each of the at least one tab disposed outside of the inner edge of corresponding end seal, relative to a longitudinal center of the photoconductive member.

24. The device of claim 18, further comprising first and second end seals disposed at respective end portions of the photoconductive member and biased to contact the blade, the elongated seal, and the at least one tab to prevent toner escape, wherein each of the at least one tab at the at least one longitudinal end of the elongated seal has an inside edge and the first and second end seals have inner edges, the inside edge of each of the at least one tab being substantially aligned with the inner edges of a corresponding end seal.

25. The device of claim 18, further comprising first and second end seals disposed at respective end portions of the photoconductive member and biased to contact the blade, the elongated seal, and the at least one tab to prevent toner escape, wherein each of the at least one tab at the at least one longitudinal end of the elongated seal has an inside edge and the first and second end seals have inner edges, the inside edge of each of the at least one tab located offset from the inner edge of a corresponding end seal.

* * * * *